US006119655A

United States Patent [19]

Heinitz et al.

[11] Patent Number: 6,119,655

[45] Date of Patent: Sep. 19, 2000

[54] DEVICE AND METHOD FOR REGULATING A PRESSURE IN ACCUMULATOR INJECTION SYSTEMS HAVING AN ELECTROMAGNETICALLY ACTUATED PRESSURE ADJUSTING ELEMENT

[75] Inventors: Dirk Heinitz, Schönhofen; Benno Larisch, Schwandorf; Martin Hecker, Laimerstadt, all of Germany

[73] Assignee: Siemens Aktiengesellschaft, Munich, Germany

[21] Appl. No.: 09/404,493

[22] Filed: Sep. 23, 1999

Related U.S. Application Data

[63] Continuation of application No. PCT/DE97/00147, Jan. 21, 1999.

[30] Foreign Application Priority Data

Jan. 23, 1998 [DE] Germany ..... 198 02 583

[51] Int. Cl.[7] ..... F02M 33/04

[52] U.S. Cl. ..... 123/447; 123/458

[58] Field of Search ..... 123/457, 458, 123/447, 510–11

[56] References Cited

U.S. PATENT DOCUMENTS

| | | | |
|---|---|---|---|
| 4,422,420 | 12/1983 | Cromas et al. | 123/458 |
| 5,085,193 | 2/1992 | Morikawa | 123/458 |
| 5,727,515 | 3/1998 | Biester | 123/458 |
| 5,727,525 | 3/1998 | Tsuzuki | 123/447 |
| 5,738,071 | 4/1998 | Smith, Jr. et al. | 123/357 |

FOREIGN PATENT DOCUMENTS

| | | |
|---|---|---|
| 2742809 | 6/1997 | France . |
| 4020654A1 | 1/1992 | Germany . |
| 19548278A1 | 6/1997 | Germany . |
| 19604552A1 | 8/1997 | Germany . |

OTHER PUBLICATIONS

Published International Application No. 96/03577 (Antonioli et al.), dated Feb. 8, 1996.

*Primary Examiner*—Thomas N. Moulis
*Attorney, Agent, or Firm*—Herbert L. Lerner; Laurence A. Greenberg; Werner H. Stemer

[57] ABSTRACT

A device for regulating a pressure in a high pressure accumulator of a fuel injection system includes a pressure adjusting element which has a shut-off element and an electromagnetic drive actuating the shut-off element. A first regulating device is connected to the pressure adjusting element and compares a pressure value obtained in the high pressure accumulator with a given setpoint pressure value. A drive signal with a setpoint current value for the electromagnetic drive is determined as a function of the comparison. A second regulating device is connected downstream of the first regulating device for comparing a current value of a current flowing through the electromagnetic drive with the setpoint current value and readjusting the current value in response to a deviation between the current value and the setpoint current value. A method for regulating a pressure in a high pressure accumulator is also provided.

8 Claims, 2 Drawing Sheets

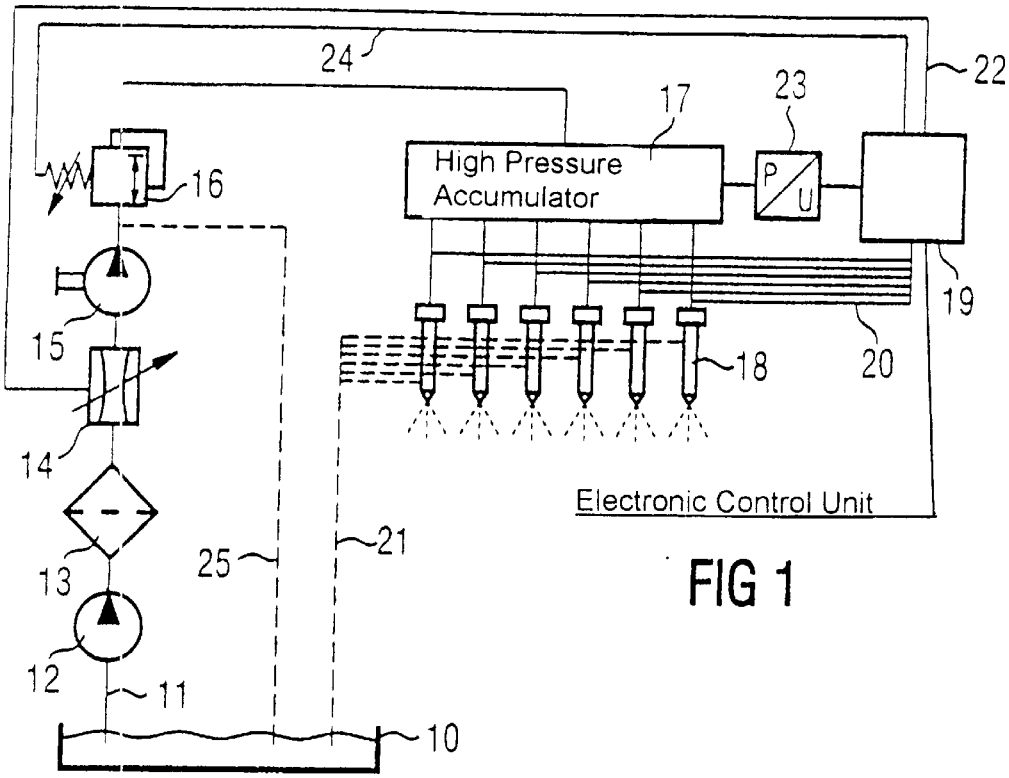
FIG 1
FIG 2
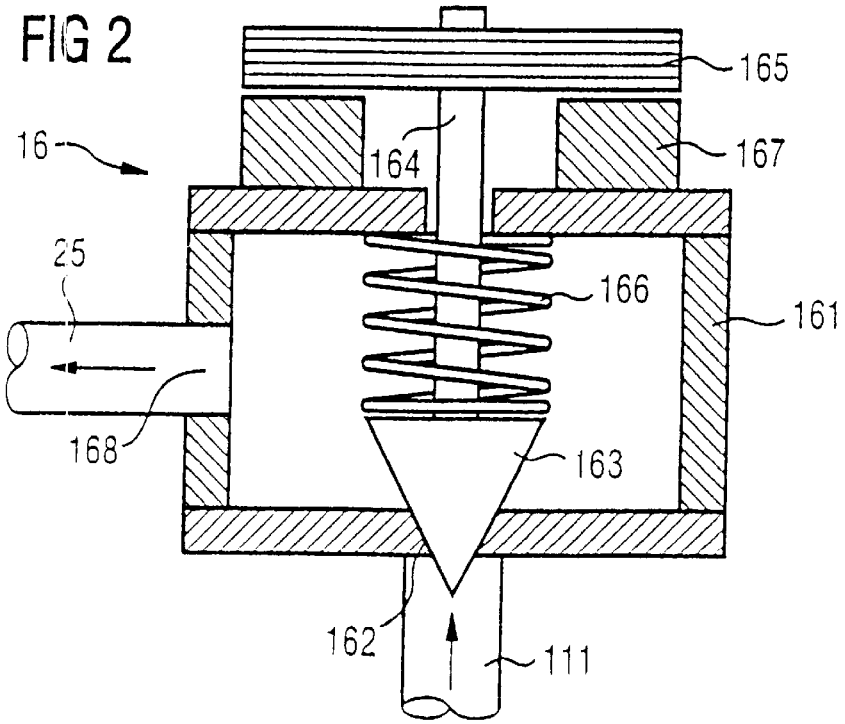

DEVICE AND METHOD FOR REGULATING A PRESSURE IN ACCUMULATOR INJECTION SYSTEMS HAVING AN ELECTROMAGNETICALLY ACTUATED PRESSURE ADJUSTING ELEMENT

CROSS-REFERENCE TO RELATED APPLICATION

This is a continuation of copending International Application PCT/DE99/00147, filed Jan. 21, 1999, which designated the United States.

BACKGROUND OF THE INVENTION

Field of the Invention

The invention relates to a device and a method for regulating a pressure in a high pressure accumulator for fuel injection systems having a pressure adjusting element which has a shut-off element which is actuated by an electromagnetic drive.

In the field of fuel injection systems for internal combustion engines, high pressure accumulator configurations which comprise essentially a high pressure pump, a high pressure accumulator, injection valves and an electronic control device with sensors have increasingly gained prominence in the last few years.

In order to be able to adapt the pressure in the high pressure accumulator, which determines the injection pressure, precisely and quickly to the respective operating conditions of the internal combustion engine, the high pressure accumulator is further provided with a pressure adjusting element or pressure control element by which excess fuel, which is not required to maintain the desired pressure in the high pressure accumulator, is fed back into the fuel tank.

The holding pressure in the pressure adjusting element is regulated by the electronic control unit of the internal combustion engine in accordance with an actual value which is measured by a pressure sensor in the high pressure accumulator and the set point value or desired value which is desired in the respective operating state of the internal combustion engine.

Since the solenoids or magnetic coils which are used in the pressure adjusting elements are made from a conductive material whose specific resistance is temperature-dependent, the current flowing through the solenoid, and thus also the armature force acting on the shut-off element, is influenced by the temperature of the solenoid. Due to the temperature-dependent resistance in the coil winding, the increase in temperature leads to a change in the current flowing through the solenoid and thus t a change in the resulting holding force in the pressure adjusting element. The holding force generally decreases because the coil materials which are used are usually conductors in which the resistance rises as the temperature increases, leading to a decrease in current.

However, since the change in the holding force of the shut-off element in the pressure adjusting element which is brought about by the temperature of the solenoid influences the pressure in the high pressure accumulator, the pressure adjusting element of the electronic control unit of the internal combustion engine must make an adjustment in order to be able to set the desired pressure in the pressure accumulator. However, this adjustment leads to a degradation of the control dynamics of the pressure adjusting element, so that the pressure which is optimum for the operating condition in the high pressure accumulator is achieved only with a delay. In order to prevent an excessively long delay in the regulation of the pressure in the high pressure accumulator, wide control range limits are generally used for prior art PI (proportional-integral) controllers for the pressure adjusting element, so that a sufficient adjustment speed is obtained during the regulation of the pressure. However, such high adjustment speeds increase the risk of overshooting when regulating the pressure, and thus adversely affect the stability of the regulating circuit. In addition, high adjustment speeds often lead to very high current peaks in the solenoid of the pressure adjusting element, which can cause damage.

The Published German Patent Application DE 195 48 278 A 1 discloses a method and a device for regulating a high pressure regulating valve connected to a high pressure accumulator. A current value which is detected in the electromagnetic drive of the high pressure regulating valve is compared with a setpoint current value which is derived from a desired setpoint pressure value. In case of a deviation, the value of the current which flows through the electromagnetic drive of the high pressure regulating valve is readjusted.

SUMMARY OF THE INVENTION

It is accordingly an object of the invention to provide a method and a device for regulating a pressure in an accumulator injection system having an electromagnetically actuated pressure adjusting element which overcome the above-mentioned disadvantages of the heretofore-known methods and devices of this general type and which ensure that the control dynamics are at an optimum and at the same time reliably avoid damage to the electromagnetic drive of the pressure adjusting element.

With the foregoing and other objects in view there is provided, in accordance with the invention, in combination with a high pressure accumulator for a fuel injection system, a device for regulating a pressure in the high pressure accumulator, comprising a pressure adjusting element connected to the high pressure accumulator and having a shut-off element and an electromagnetic drive actuating the shut-off element; a first regulating device connected to the pressure adjusting element for performing a comparison between a pressure value obtained in the high pressure accumulator and a given setpoint pressure value, and, as a function of the comparison, determining a drive signal with a setpoint current value for the electromagnetic drive; and a second regulating device connected downstream of the first regulating device for comparing a current value of a current flowing through the electromagnetic drive with the setpoint current value and readjusting the current value in response to a deviation between the current value and the setpoint current value.

In accordance with another feature of the invention, the first regulating device is a pressure regulator and the second regulating device is a current regulator.

In accordance with yet another feature of the invention, the pressure regulator is a PI controlled pressure regulator.

In accordance with a further feature of the invention, the first regulating device determines a pulse-width-modulated drive signal and is configured for setting a pulse duty ratio for the pulse-width-modulated drive signal.

In accordance with an added feature of the invention, the electromagnetic drive includes a magnet armature and a current-conducting solenoid moving the magnet armature.

With the objects of the invention in view there is also provided, a method for regulating a pressure in a high pressure accumulator for a fuel injection system having a pressure adjusting element connected to the high pressure accumulator, the pressure adjusting element having a shut-off element actuated by an electromagnetic drive. The method comprises the steps of comparing a pressure value obtained in a high pressure accumulator with a given set-point pressure value; determining a drive signal with a setpoint current value for an electromagnetic drive of a pressure adjusting element as a function of the comparing step; obtaining a current value of a current flowing in the electromagnetic drive; and adapting the current value of the current flowing through the electromagnetic drive to the setpoint current value.

In accordance with another mode of the invention, the drive signal with the setpoint current value for the electromagnetic drive is determined using a PI control.

In accordance with yet another mode of the invention, the drive signal for the electromagnetic drive is a pulse-width-modulated signal and the pulse-width-modulated signal is controlled by changing a pulse duty factor of the pulse-width-modulated signal.

According to the invention, a pressure adjusting element is set through the use of a cascade control. A first regulating device compares a pressure value, detected in a high pressure accumulator, with a setpoint value and, depending on this comparison, determines a drive signal with a setpoint current value for a solenoid of the electromagnetically actuated pressure adjusting element. A second, downstream-connected regulating device obtains a current value of the current that flows in the solenoid, compares it with the setpoint current value and makes an adjustment to the current value in the solenoid as a function of this comparison. Through the use of this cascade control of the electromagnetically driven pressure adjusting element in accordance with the invention, during which there is an additional, subsequent adjustment or resetting of the current flowing through the solenoid, it is possible to compensate in a simple manner the dependence of this current on the temperature of the solenoid and thus to shorten control delays when setting the pressure in the high pressure accumulator. Furthermore, the control according to the invention is defined by a high level of control stability, because sufficient control dynamics are achieved even at low adjustment speeds of the pressure adjusting element. Moreover, high current peaks in the solenoid, which could cause damage, are also avoided.

Other features which are considered as characteristic for the invention are set forth in the appended claims.

Although the invention is illustrated and described herein as embodied in a device and a method for regulating pressure in an accumulator injection system having an electromagnetically actuated pressure adjusting element, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 1 is a schematic diagram of a fuel injection system;

FIG. 2 is a diagrammatic sectional view of a pressure regulating valve; and

DESCRIPTION OF THE PREFERRED EMBODIMENTS

Figure 3:
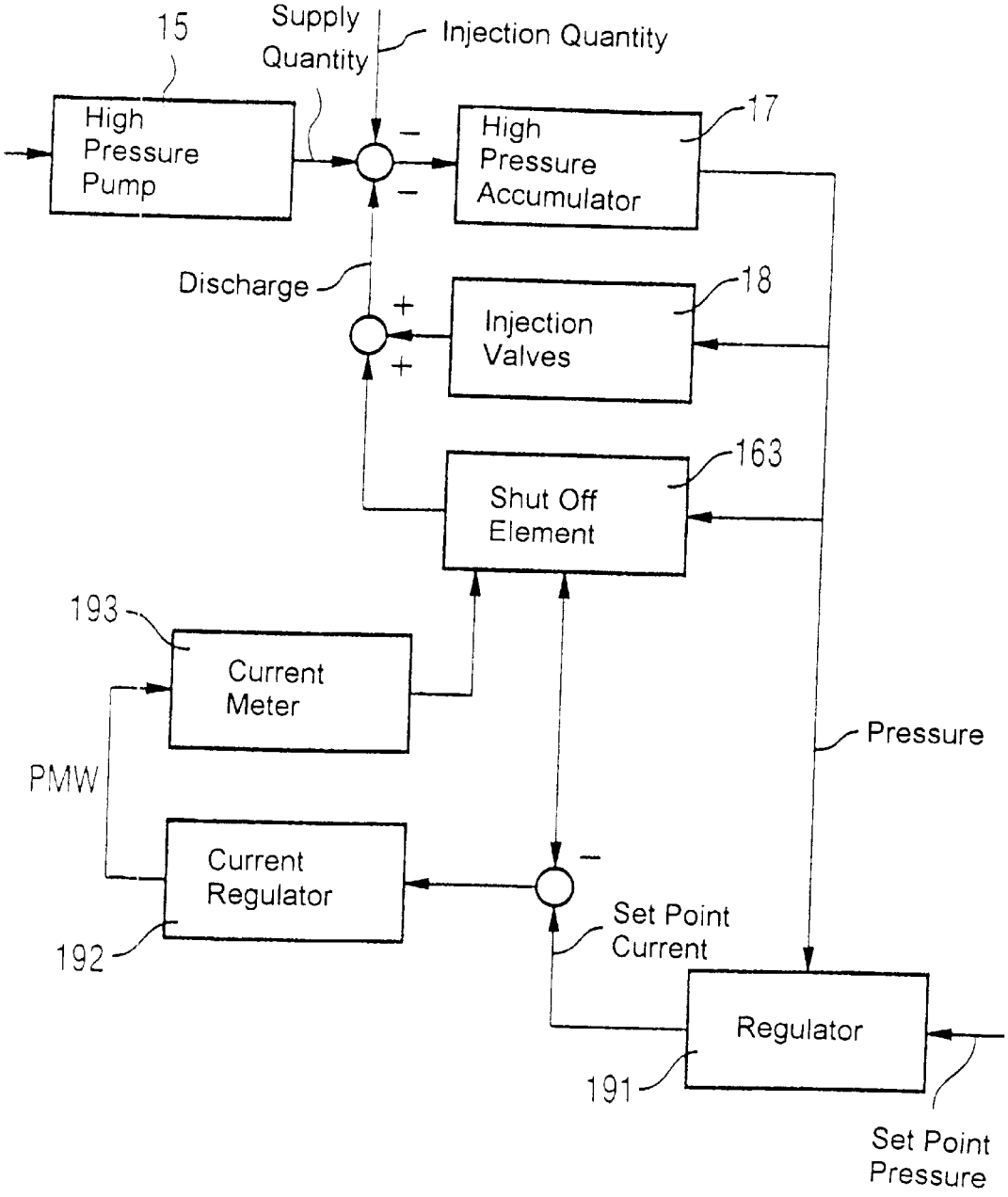
FIG. 3 is a schematic block diagram illustrating the regulation of the pressure according to the invention.

Referring now to the figures of the drawings in detail and first, particularly, to FIG. 1 thereof, there is shown a schematic diagram of a fuel injection system. The fuel injection system shown in FIG. 1 is called a common-rail system and may be used in diesel engines. In this injection system, fuel is drawn out of a fuel tank or fuel reservoir vessel 10 via a fuel line 11 through the use of a presupply pump 12 and is fed from the latter to a high pressure pump 15 via a fuel filter 13. The high pressure pump 15 then feeds the fuel under high pressure into a high pressure accumulator 17. The high pressure accumulator 17 is connected to injection valves 18, via which the fuel is injected into the cylinders of the internal combustion engine (not shown). The injection process is triggered by an electronic control unit 19, which is connected to the injection valves 18 via signaling lines 20. The leakage flow occurring in the injection valves 18 is fed back into the fuel vessel 10 via fuel lines 21.

In order to be able to set the volume flow of the high pressure pump 15 according to requirements in accordance with the respective operating conditions of the internal combustion engine, in the embodiment shown in FIG. 1 an additional suction throttle valve 14 is provided. The suction throttle valve 14 is controlled by the electronic control unit 19 via a control line 22 and regulates the delivery flow of the high pressure pump 15. The suction throttle valve 14 is provided along the fuel line 11 between the presupply pump 12 and the high pressure pump 15.

In addition, a pressure regulating valve 16 is connected into the fuel line 11 between the high pressure pump 15 and the pressure accumulator 17 in order to regulate pressure in the high pressure accumulator 17 in accordance with the desired operating conditions of the internal combustion engine. This pressure regulating valve 16 controls the discharge of excess fuel into the fuel reservoir vessel 10 via a fuel line 25. The excess fuel is not required to maintain the pressure prevailing in the high pressure accumulator 17. The pressure regulating valve 16 is set here by the electronic control unit 19 through the use of an integrated regulating unit via a control line 24 in accordance with a pressure which is measured by a pressure sensor 23 which is mounted on the pressure accumulator 17. FIG. 2 shows a schematic sectional view of the construction of the pressure regulating valve 16. This pressure regulating valve 16 has a valve housing 161 with an inlet opening 162 which is connected to the high pressure accumulator 17 via a fuel line 111. In addition, an outlet opening 168 is provided in the valve housing 161, the opening being connected to the fuel line 25 which leads back into the fuel reservoir vessel 10. The inlet opening 162 has a seal seat which opens inward in a conical shape and into which a shut-off element 163, which is also of a conical construction, engages. This shut-off element 163 is seated with its base surface on one end of a closing rod 164 which projects with its other end through a hole out of the valve housing 161. In addition, a valve spring 166, which applies a spring prestress to the shut-off element, is provided around the closing rod 164 between the valve housing 161 and the base surface of the shut-off element 163. At the end of the closing rod 164 which projects out of the valve housing 161 there is a magnet armature 165, a current-conducting solenoid 167 being provided around the closing rod 164 between the magnet armature 165 and the valve housing 161.

The pressure regulating valve 16 which is shown schematically in FIG. 2 operates as follows: In the closing direction, a holding force, which is composed of the spring force provided by the spring 166 and of the armature force generated by the current-conducting solenoid 167, acts on the shut-off element 163. In contrast, in the opening direction the fuel pressure which prevails in the high pressure accumulator 17 acts on the shut-off element 167 via the fuel line 111. If the pressure force which is exerted on the shut-off element 163 and which results from the fuel pressure exceeds the counteracting holding force of the spring 166 and magnet armature 165, the shut-off element 163 lifts off from the seal seat in the inlet opening 162 and causes the excess fuel to discharge out of the high pressure accumulator 17 back into the fuel reservoir vessel 10 via the fuel line 25. By changing the current applied to the solenoid 167 it is possible to set the armature force and thus the holding force which acts on the shut-off element 163 and which counteracts the fuel pressure.

The solenoid 167 of the pressure regulating valve 16 generally has a pulse-width-modulated drive signal applied to it by the regulating unit of the electronic control unit 19. By changing the pulse duty ratio of this pulse-width-modulated drive signal, and thus the current pulse length for the solenoid 167, the regulating unit of the electronic control unit 19 adapts the armature force, and thus the holding force of the pressure regulating valve 19, to the desired pressure in the high pressure accumulator 17.

As is shown by the block circuit diagram in FIG. 3, the regulating unit of the electronic control unit 19 is composed of a cascade circuit of a regulator 191 and a downstream-connected current regulator 192. The following regulating process is carried out: The pressure prevailing in the high pressure accumulator 17 is determined by the fuel quantity contained in the high pressure accumulator. This fuel quantity is composed of the flow of fuel which is fed in by the high pressure pump 15, of the injection quantity which is discharged during the injection, the leakage flow which flows off via the injection valve and the fuel which is discharged via the pressure regulating valve 16. Both the leakage current of the injection valves and the fuel quantity discharged via the pressure regulating valve 16 depend on the fuel pressure prevailing in the high pressure accumulator 17.

As shown in more detail by the block circuit diagram in FIG. 3, in order to regulate the pressure regulating valve 16, the pressure value determined in the high pressure accumulator 17 using the pressure sensor 23 is compared with a setpoint pressure value in the regulator 191 of the electronic control unit 19. The electronic control unit 19 obtains the setpoint pressure value from a memory device, constructed as a unidimensional or multidimensional data field, in accordance with the operating conditions of the internal combustion engine, in particular its load or rotational speed. The regulator 191, which is preferably constructed as a PI controller, determines, from the difference pressure value, which is obtained by subtracting the setpoint pressure value from the fuel pressure measured in the high pressure accumulator 17, a regulator value TV according to the following equation:

$$TV = K_p\left(p_{dif} + \frac{1}{T_n}\int p_{dif}\,dt\right)$$

$P_{dif}$=differential pressure value;

$K_p$=a predefined amplification factor;

$T_n$=a predefined reset time (subsequent adjustment time).

The amplification factor and the reset time (subsequent adjustment time) are predefined in accordance with the desired control response of the pressure regulating valve 16. The calculated regulating value TV constitutes a pulse duty ratio of the pulse-width-modulated drive signal for the current-conducting solenoid 167 of the pressure regulating valve 16, the pulse duty ratio representing the ratio of pulse length, i.e. the time during which the solenoid 167 is supplied with current, to the period length, that is to say the distance between two current pulses. Here, the regulating value which is output to the current-conducting solenoid 167 continues to have a fixed current value. By applying current to the solenoid 167, an armature force is exerted on the shut-off element 163 in the pressure regulating valve 16 via the magnet armature 165. This force, together with the spring force 166, determines the holding force of the shut-off element 163 counteracting the fuel pressure. The free flow passage (flow cross section), which results from the equilibrium of forces acting on the shut-off element 163, through the inlet opening 162 of the pressure regulating valve determines the fuel flow which is discharged via the pressure regulating valve 16, and thus determines the pressure prevailing in the high pressure accumulator 17.

However, the current flowing through the solenoid 167 causes heat to be generated in the solenoid 16 due to the resistance heating that occurs in the current-conducting coil elements. This generation of heat also influences the temperature-dependent, specific resistance of the current-conducting elements in the solenoid 16, in which case, with conventionally used current-conducting elements, the resistance rises with the temperature. This rise in the resistance in the current-conducting coil elements which is caused by the generation of heat leads in turn to a decrease in the current value flowing through the solenoid 167. However, as a consequence of this decrease in the current value, the armature force acting on the shut-off element 163 is reduced, which leads to an increase in pressure in the high pressure accumulator 17.

In order to compensate the control error (control deviation) caused by the temperature-dependence of the current flowing through the solenoid 167, the current value flowing through the coil is determined with a current meter 193 and is compared with the setpoint current value in a current regulator 192. This current regulator 192 then compensates a difference between the measured current value and the setpoint current value by additionally supplying current to the solenoid 167, so that the desired holding force is again set at the pressure regulating valve 16.

According to the invention, the additional measured variable of the magnet current value, and its resetting, i.e. subsequent adjustment, in a secondary regulating circuit compensates the interfering factors influencing the regulation of the pressure regulating valve 16 which are caused by the temperature-dependence of current flowing through the solenoid, so that a very fast regulating circuit with a high level of control dynamics is obtained. The PI controller 191, the current meter 193 and the current regulator 192 can also be integrated directly into the pressure regulating valve 16, instead of into the electronic control unit 19. In addition, the regulation of the pressure according to the invention can be carried out in internal combustion engines with all types of pressure regulating elements having an electromagnetic drive.

We claim:

1. In combination with a high pressure accumulator for a fuel injection system, a device for regulating a pressure in the high pressure accumulator, comprising:

a pressure adjusting element connected to the high pressure accumulator and having a shut-off element and an electromagnetic drive actuating said shut-off element;

a first regulating device connected to said pressure adjusting element for performing a comparison between a pressure value obtained in the high pressure accumulator and a given setpoint pressure value, and, as a function of the comparison, determining a drive signal with a setpoint current value for said electromagnetic drive; and a second regulating device connected downstream of said first regulating device for comparing a current value of a current flowing through said electromagnetic drive with the setpoint current value and readjusting the current value in response to a deviation between the current value and the setpoint current value.

2. The device according to claim 1, wherein said first regulating device is a pressure regulator and said second regulating device is a current regulator.

3. The device according to claim 2, wherein said pressure regulator is a PI controlled pressure regulator.

4. The device according to claim 1, wherein said first regulating device determines a pulse-width-modulated drive signal and is configured for setting a pulse duty ratio for the pulse-width-modulated drive signal.

5. The device according to claim 1, wherein said electromagnetic drive includes a magnet armature and a current-conducting solenoid moving said magnet armature.

6. A method for regulating a pressure in a high pressure accumulator for a fuel injection system having a pressure adjusting element connected to the high pressure accumulator, the pressure adjusting element having a shut-off element actuated by an electromagnetic drive, the method which comprises:

comparing a pressure value obtained in a high pressure accumulator with a given setpoint pressure value;

determining a drive signal with a setpoint current value for an electromagnetic drive of a pressure adjusting element as a function of the comparing step;

obtaining a current value of a current flowing in the electromagnetic drive; and adapting the current value of the current flowing through the electromagnetic drive to the setpoint current value.

7. The method according to claim 6, which comprises determining the drive signal with the setpoint current value for the electromagnetic drive using a PI control.

8. The method according to claim 6, wherein the drive signal for the electromagnetic drive is a pulse-width-modulated signal and which comprises controlling the pulse-width-modulated signal by changing a pulse duty factor of the pulse-width-modulated signal.

* * * * *